United States Patent [19]

Toshimitsu et al.

[11] Patent Number: 4,711,555

[45] Date of Patent: Dec. 8, 1987

[54] IMAGE FORMING APPARATUS HAVING MEANS FOR PREVENTING DAMAGE TO A PHOTOSENSITIVE MEMBER

[75] Inventors: Kenshi Toshimitsu, Kawasaki; Hiromasa Kohayakawa, Tokyo, both of Japan

[73] Assignee: Kabushiki Kaisha Toshiba, Kawasaki, Japan

[21] Appl. No.: 857,033

[22] Filed: Apr. 29, 1986

[30] Foreign Application Priority Data

Apr. 30, 1985 [JP] Japan ..... 60-92563
Apr. 30, 1985 [JP] Japan ..... 60-93121

[51] Int. Cl.[4] ..... G03G 21/00; G03G 15/06

[52] U.S. Cl. ..... 355/14 R; 355/15; 355/14 D; 118/652

[58] Field of Search ..... 355/15, 3 R, 3 DD, 14 D, 355/14 R; 118/652

[56] References Cited

U.S. PATENT DOCUMENTS

| | | | |
|---|---|---|---|
| 4,077,711 | 3/1978 | Akamatsu | 355/15 X |
| 4,155,652 | 5/1979 | Buchan et al. | 356/342 |
| 4,333,130 | 6/1982 | Mochizuki et al. | 362/293 |
| 4,396,276 | 8/1983 | Murasaki | 355/15 |

OTHER PUBLICATIONS

Patents Abstracts of Japan, vol. 6, No. 203, p. 148 (1081) Oct. 14, 1982 & JP-A 57 111 578, Jul. 12, 1982.
Patent Abstracts of Japan, vol. 7, No. 274, p. 241 (1419) Dec. 7, 1983 & JP-A 58 153 979, Sep. 13, 1983.

*Primary Examiner*—R. L. Moses
*Attorney, Agent, or Firm*—Schwartz, Jeffery, Schwaab, Mack, Blumenthal & Evans

[57] ABSTRACT

In initially setting a copying apparatus from a factory at a user's site of installation, an operator first connects the apparatus to power supply. Thereupon, toner density adjusting means in a developing unit is actuated to adjust the toner content of a developing agent in the developing unit to a predetermined value. Then, a discharge lamp glows, and the surface of a photosensitive drum is charged by a main charger. If the drum surface is rotated to reach the developing unit without being exposed to light, a toner is supplied from the developing unit to the surface to form a toner layer thereon. When the toner layer reaches the location of a cleaning blade, the blade engages the drum surface to remove the toner layer thereon. Thus, the toner layer serves as a lubricant, enabling the blade to fit well with the drum surface.

11 Claims, 27 Drawing Figures to
t1

IMAGE FORMING APPARATUS HAVING MEANS FOR PREVENTING DAMAGE TO A PHOTOSENSITIVE MEMBER

BACKGROUND OF THE INVENTION

The present invention relates to an image forming apparatus such as an electrophotographic copying apparatus.

Conventionally, in electrophotographic copying apparatuses delivered from a factory, a photosensitive drum and cleaning blade are set i.e., installed at a user's site of installation. If the unused drum and blade are suddenly brought into contact with each other when the drum is rotated, a great frictional force is produced between them. As a result, the surface of the drum may be damaged, or the blade may get turned up to spoil its edge face. If damaged, the blade edge face cannot enjoy a satisfactory cleaning effect, allowing a film of residual toner to be formed on the drum surface.

In initially setting the electrophotographic photosensitive drum at the user's station, therefore, an operator applies a powdered lubricant, such as polyvinyidene fluoride with a particle diameter of about 5 microns, to the peripheral surface of the drum. Thereafter, the drum is set in the apparatus and rotated, and the cleaning blade is brought into contact with the drum surface. Thus, the frictional force between blade and drum at the time of initial setting is reduced.

However, the manual initial setting work costs the operator much time and labor. Since the surface of the photosensitive drum is very delicate and liable to be damaged or marked with fingerprints during the application of the powdered lubricant or the mounting of the drum in the apparatus housing. Thus, the operator's manual operation is not very reliable.

SUMMARY OF THE INVENTION

The object of the present invention is to provide an image forming apparatus in which a cleaning blade can easily and quickly be made to fit well with the surface of a photosensitive member without requiring a manual initial setting work and without damaging the surface.

According to the invention, there is provided an image forming apparatus which comprises a drum-shaped photosensitive member having an axis of rotation; drive means for rotating the photosensitive member about the rotation axis; charging means for forming an electric charged region on the surface of the photosensitive member; latent image forming means for irradiating the charged region of the photosensitive member with a light to form an electrostatic latent image on the surface; developing means for supplying a toner to the surface of the photosensitive member to develop the electrostatic latent image into a visible image formed of the toner; a cleaning blade for removing the residual toner on the surface of the photosensitive member; blade supporting means adapted to bring the cleaning blade into contact with the surface of the photosensitive member; means for de-electrifying the surface of the photosensitive member; and control means having an initial setting mode and an operating mode, and adapted, when the initial setting mode is selected, to actuate first the drive means, de-electrifying means, and charging means, and thereafter to energize the developing means to form a layer of the toner on the surface of the photosensitive member, and to actuate the blade supporting means to bring the cleaning blade into contact with the surface of the photosensitive member when the toner layer reaches the location of the cleaning blade.

According to the present invention, the cleaning blade is in sliding contact with the drum surface with the toner layer in between for predetermined time $t_0$. Since the toner layer serves as a lubricant, no substantial frictional force acts between blade and the drum surface of the photosensitive member. Accordingly, the blade is protected against burr, and the drum surface cannot be damaged by friction. Thus, the initial setting of the copying apparatus ends, and blade and drum are made to fit well with each other to be ready for the start of the copy process. Since the photosensitive member is already mounted in the housing of the copying apparatus by the time of shipment, the operator need not set the drum in each individual apparatus at the user's site of installation. Moreover, the initial setting of the cleaning blade is effected automatically in the apparatus, so that the drum can never be damaged. Thus, the electrophotographic photosensitive drum can enjoy a secure initial setting.

DETAILED DESCRIPTION OF THE PREFERRED EMBODIMENTS

A first embodiment of the present invention will now be described in detail with reference to the accompanying drawings.

Figure 1:
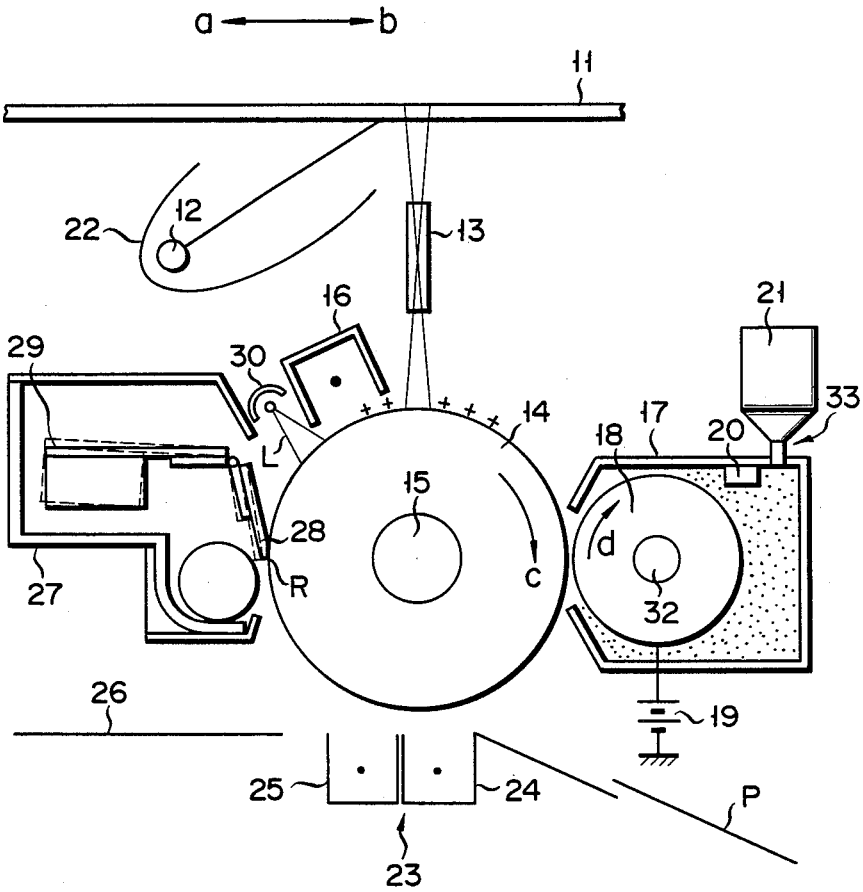
FIG. 1 shows an electrophotographic copying apparatus according to a first embodiment of the present invention.

In FIG. 1, an original cover (not shown) is put on original table 11 which is formed of e.g. transparent glass. An original is set on table 11, and the table is moved in the directions of arrows a and b when a copy key of a control panel (not shown) is depressed. Exposure lamp 12 for irradiating table 11 is disposed under the table. It is backed by reflector member 22. A reflected light from table 11 illuminated by lamp 12 is transmitted through rod lens array 13 to photosensitive drum 14. Drum 14 is rotated in the direction of arrow c by motor 15 as drive means. The surface of drum 14 is first charged, for example, positively by main charger 16 as charging means, and then selectively exposed to the light reflected from the original and guided through lens array 13. As a result, an electrostatic latent image is formed on the drum surface. A toner is supplied and attached to the latent image by developing roller 8 of developing unit 17 as developing means. Thus, the latent image is visualized or developed into a toner image. Paper sheet P, as an object of transfer, is taken out of a paper cassette (not shown) and fed into transfer section 23. In section 23, it is brought closely into contact with the surface of drum 14, facing transfer charger 24, and the toner image on the drum is transferred to the sheet by the charger 24. Sheet P, carrying the transferred image thereon, is separated from photosensitive drum 14 by the separation charger 25 and transported by conveyor belt 26. Then, the image is fixed to sheet P by a pair of fixing rollers (not shown), and the sheet is discharged thereafter. After the transfer, the residual toner on the surface of drum 14 is removed by cleaning blade 28 of cleaning unit 27. Then, the residual image is erased by de-electrifying light beam L emitted from discharge lamp 30. Thus, an initial state is restored.

Developing unit 17 is stored with developing agent including toner and carrier. The toner is fed onto the surface of photosensitive drum 14 when developing roller 18 is rotated in the direction of arrow d by motor 32 as drive means. Bias voltage is applied to roller 18 by bias source 19. Hopper 21, containing the toner therein, is disposed above a housing of unit 17. Sensor 20 is provided in unit 17, whereby the toner content (ratio of toner amount to the sum of toner amount and carrier amount) of the developing agent in the developing unit is detected. When the toner in unit 17 and hence the toner content are reduced after repeated operation of the copying apparatus, sensor 20 detects the reduction of the toner content. The toner content detected by the sensor 20 and the reference toner content stored in a control unit 36 are compared in the control unit 36 and the toner in hopper 21 are caused to be fed into unit 17. Thus, the toner content of the developing agent in developing unit 17 is kept at a predetermined value.

Cleaning blade 28 of cleaning unit 27 is supported by supporting device 29 including a solenoid (not shown). In the stage of shipment at the factory, device 29 holds blade 28 apart from photosensitive drum 14, as indicated by broken line in FIG. 1. When the solenoid is actuated in response to an actuating signal from a control unit mentioned later, the cleaning blade is brought into contact with the surface of drum 14.

Figure 2:
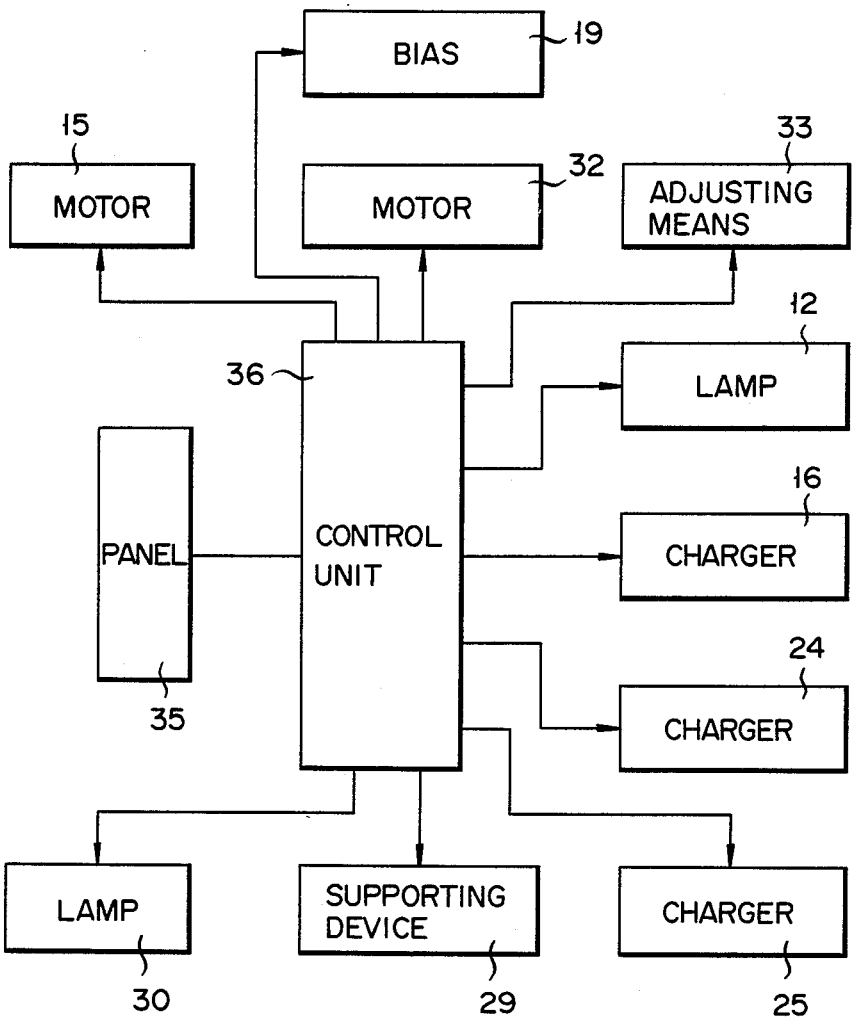
FIG. 2 is a block diagram for illustrating the control sequence of the apparatus of FIG. 1.

As shown in FIG. 2, control unit 36 serves to control motors 15 and 32 for driving photosensitive drum 14 and developing roller 18, respectively, bias source 19, and toner content adjusting means 33 including toner content sensor 20 and hopper 21. It also controls exposure lamp 12, chargers 16, 24 and 25, supporting device 29 for cleaning blade 28, and discharge lamp 30. The control unit is operated by a power switch (not shown) on control panel 35 of the copying apparatus.

Figure 3:
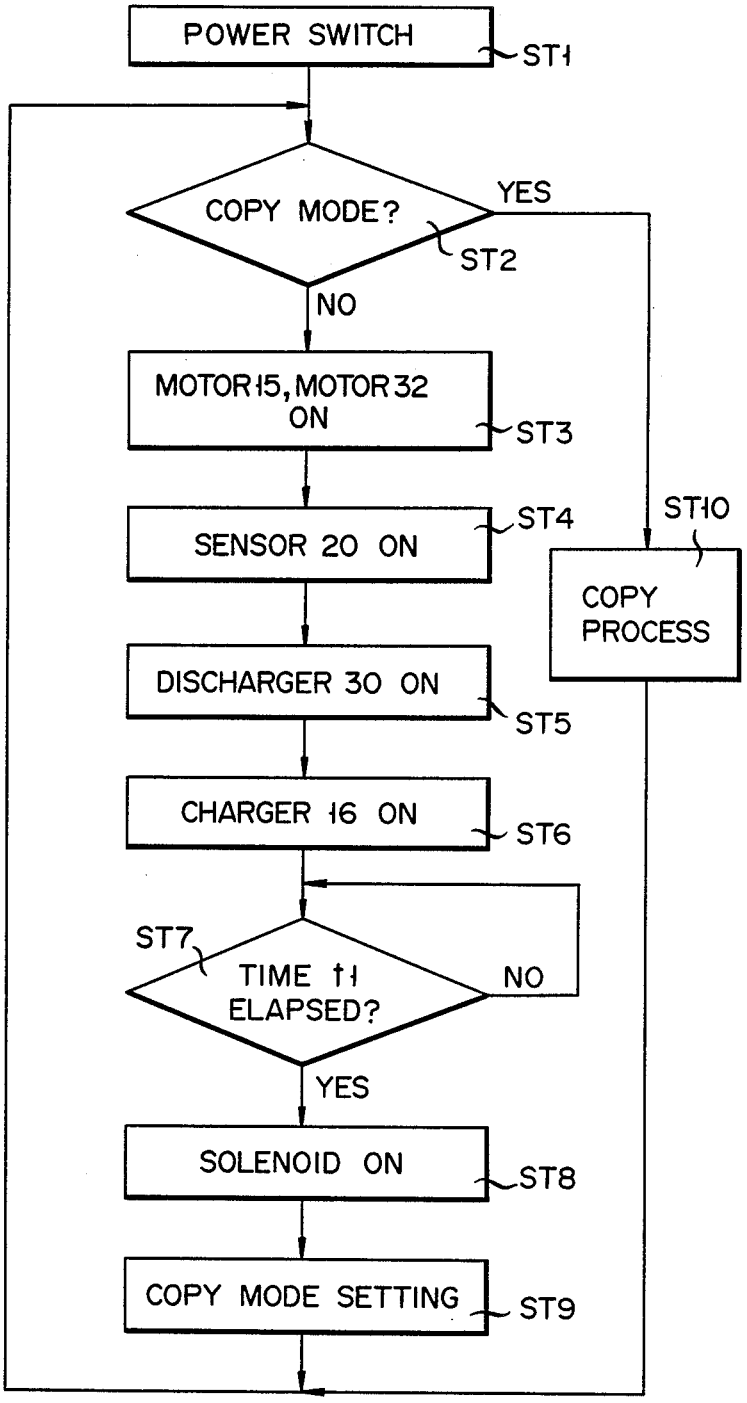
FIG. 3 is a flow chart illustrating the control sequence.
Figures 4A, 4B, 4C, 4D, 4E, 4F, 4G:
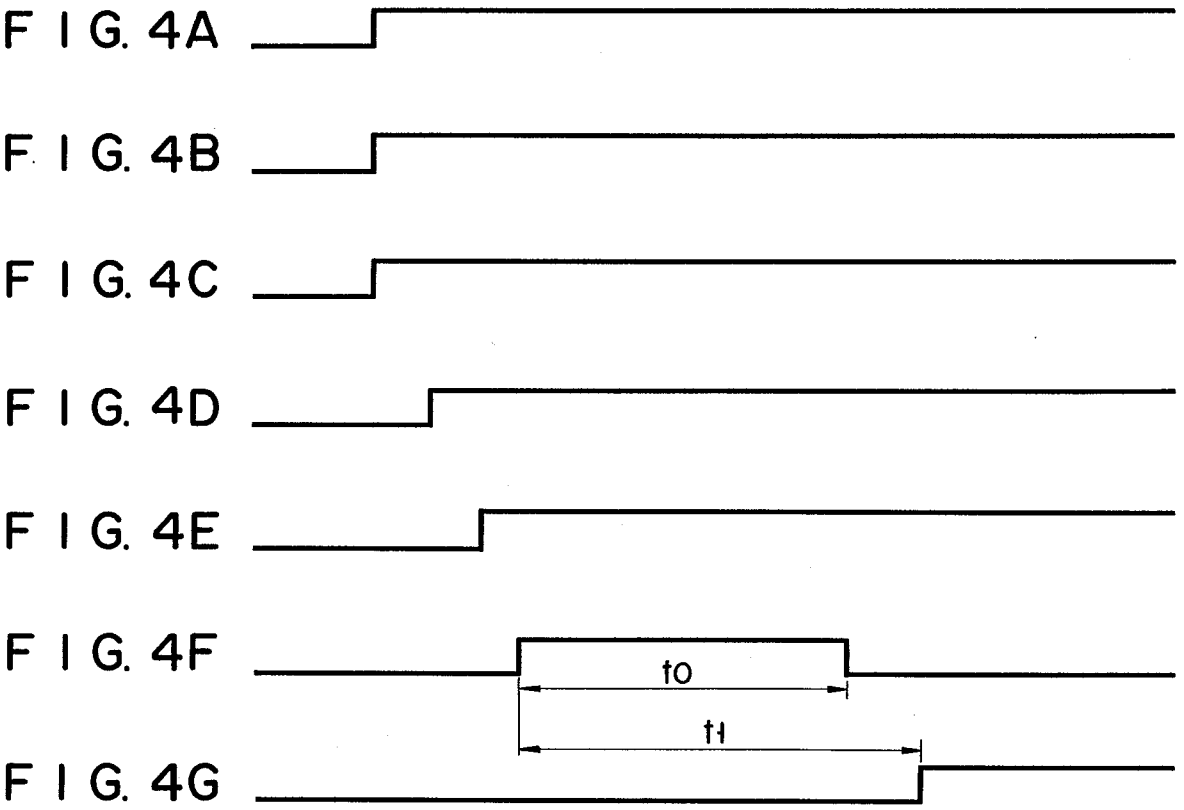
FIGS. 4A to 4C are timing charts.

In the electrophotographic copying apparatus constructed in this manner, if the power switch of control panel 35 is turned on, control unit 36 operates in the manner shown in the flow chart of FIG. 3 and timing charts of FIGS. 4A to 4G. FIG. 4A shows a signal for the on-off control of drive motor 15 for photosensitive drum 14; FIG. 4B for the on-off control of drive motor 32 for developing roller 18, FIG. 4C for the on-off control of developing bias source 19, and FIG. 4D for the start of sensor 20. Further, FIG. 4E illustrates a signal for the on-off control of discharge lamp 30, FIG. 4F for the on-off control of main charger 16, and FIG. 4G for the timing of on-off control of the solenoid (supporting device 29) to bring cleaning blade 28 into contact with the surface of drum 14.

When the electrophotographic copying apparatus, shipped out from the factory, is delivered to a user, it is first subjected to initial setting of the photosensitive drum. Then, the power switch of control panel 35 is turned on (ST1), as shown in FIG. 3. Since a copy mode is not established in control unit 36 at the beginning, "NO" is selected in step 2 (ST2), namely automatic initial setting mode is selected. First, motors 15 and 32 and developing bias source 19 are turned on to actuate developing unit 17 (ST3). The toner is caused to be circulated in unit 17 to be stirred and mixed uniformly while the toner content is set to be predetermined value when the copying apparatus is shipped out the factory. Then, toner content sensor 20 of toner content adjusting means 33 is actuated (ST4). Sensor 20 detects the toner content of the developing agent in the developing unit 17 after the toner being mixed uniformly. The toner content detected by sensor 20 is stored in control unit 36 as a reference toner content. When the current toner content is reduced below a reference toner content, the sensor causes the toner in hopper 21 to be fed into the developing unit so that the two values agree with each other. Subsequently, discharge lamp 30 is turned on to de-electrify the surface of the photosensitive drum (ST5). A short time behind lamp 30, main charger 16 is switched on (ST6). Thereafter, the drum surface, preexposed by lamp 30, is charged by charger 16 for predetermined time $t_0$. As a result, a region charged uniformly is formed on the drum surface for a circumferential length corresponding to time $t_0$. The charged region on the drum surface is developed when it moves past developing unit 17, thus forming a uniform toner layer on the peripheral surface of photosensitive drum 14. Then, after charger 16 is switched on, whether or not time $t_1$ has elapsed is determined in step 7. Time $t_1$ is a time obtained by dividing a circumferential length along the peripheral surface of drum 14 corresponding to the distance between cleaning blade 28 and charger 16 by the rotating speed of the drum. In other words, time $t_1$ is equivalent to the time interval which elapses from the instant that the charge layer on the drum surface is developed by the developing unit to form the uniform toner layer until the leading end of the toner layer reaches the location of blade 28. After time $t_1$ has elapsed, the solenoid is energized (ST8) to cause blade 28 to abut against the drum surface. Thus, when the toner layer on the drum surface reaches the location of blade 28, the blade engages the drum surface. Then, control unit 36 sets the copy mode (ST9), and step 2 is resumed. Thereupon, since the copy mode is established (YES), a copy process is started in step 10.

Cleaning blade 28 is in sliding contact with the drum surface with the toner layer in between for time $t_0$. Since the toner layer serves as a lubricant, no substantial frictional force acts between blade 28 and the drum surface. Accordingly, the blade is protected against burr, and the drum surface cannot be damaged by friction. Thus, the initial setting of the copying apparatus ends, and blade and drum are made fit well with each other to be ready for the start of the copy process. Since the photosensitive drum is already mounted in the housing of the copying apparatus by the time of shipment, the operator need not set the drum in each individual apparatus at the user's site of installation. Moreover, the initial setting of the cleaning blade is effected automatically in the apparatus, so that the drum can never be damaged. Thus, the electrophotographic photosensitive drum can enjoy a secure initial setting.

Once the setting operation ends, the copy mode is established in control unit 36, so that another setting work cannot be initiated. This control sequence may be programmed in a CPU. Alternatively, an electric circuit for executing the initial setting mode may be provided with a fuse which blows out when the mode is selected. Also, the CPU may be programmed so that the initial setting mode can be returned, or the aforesaid circuit may be incorporated in the control unit.

Referring now to FIGS. 5 to 8G, a second embodiment of the present invention will be described.

Figure 5:
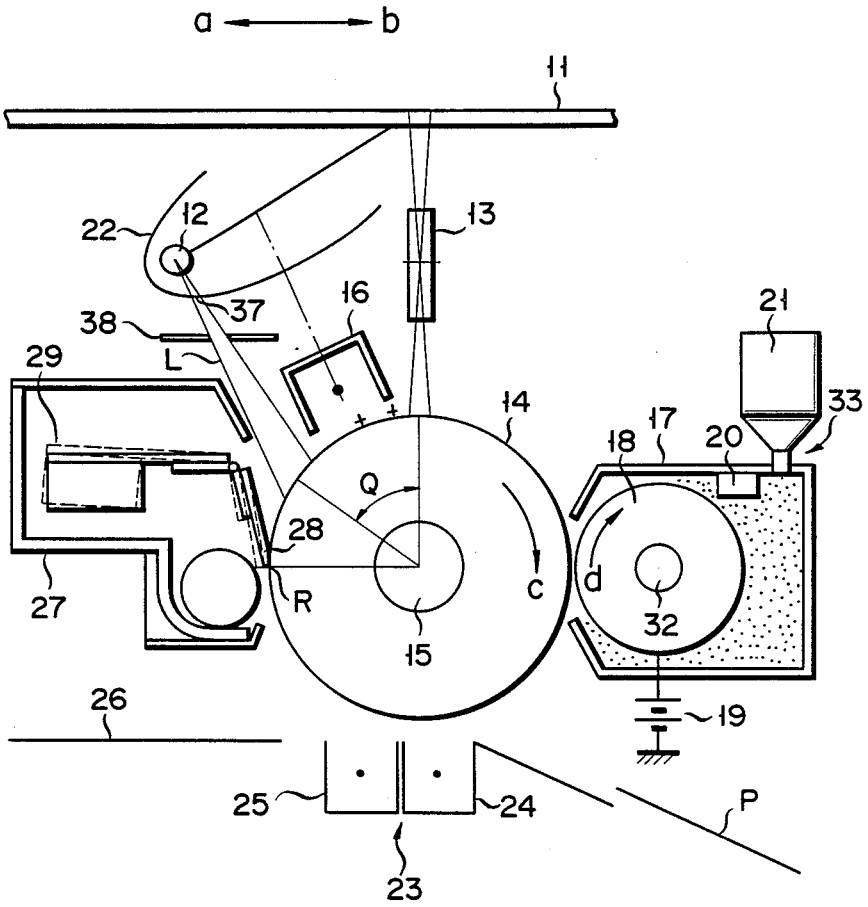
FIG. 5 shows an electrophotographic copying apparatus according to a first embodiment of the present invention.

In an electrophotographic copying apparatus according to this embodiment, an exposure lamp doubles as a discharge lamp, and a toner layer is formed on a photosensitive drum by controlling the operation timing of the exposure lamp and a main charger. The drum is set by bringing a cleaning blade into contact with the toner layer when the layer reaches the location of the blade. In FIG. 5, like reference numerals refer to like members as in FIG. 1.

Reflector member 22 at the back of exposure lamp 12 is formed with aperture 37 through which light beam L from lamp 12 comes out. The width of de-electrifying beam L is regulated by slit 38.

Referring to FIGS. 6 to 8G, the control sequence of the second embodiment will be described.

Figure 6:
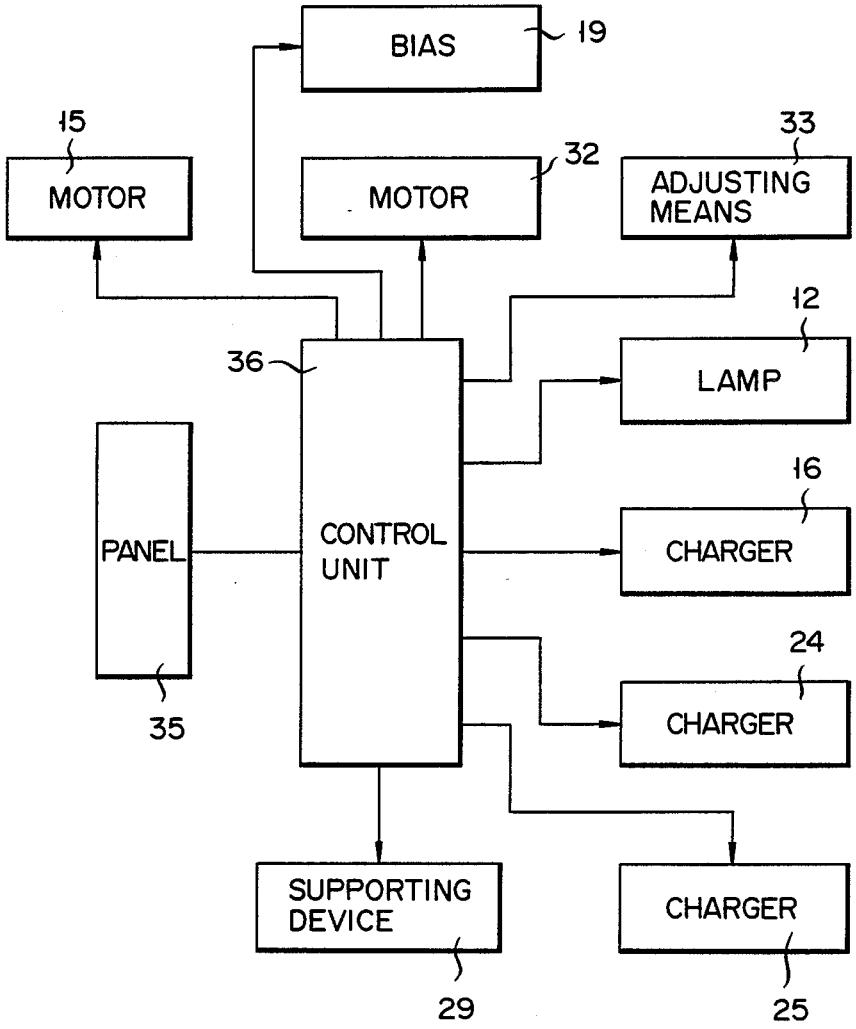
FIG. 6 is a block diagram for illustrating the control sequence of the apparatus of FIG. 5.
Figure 7:
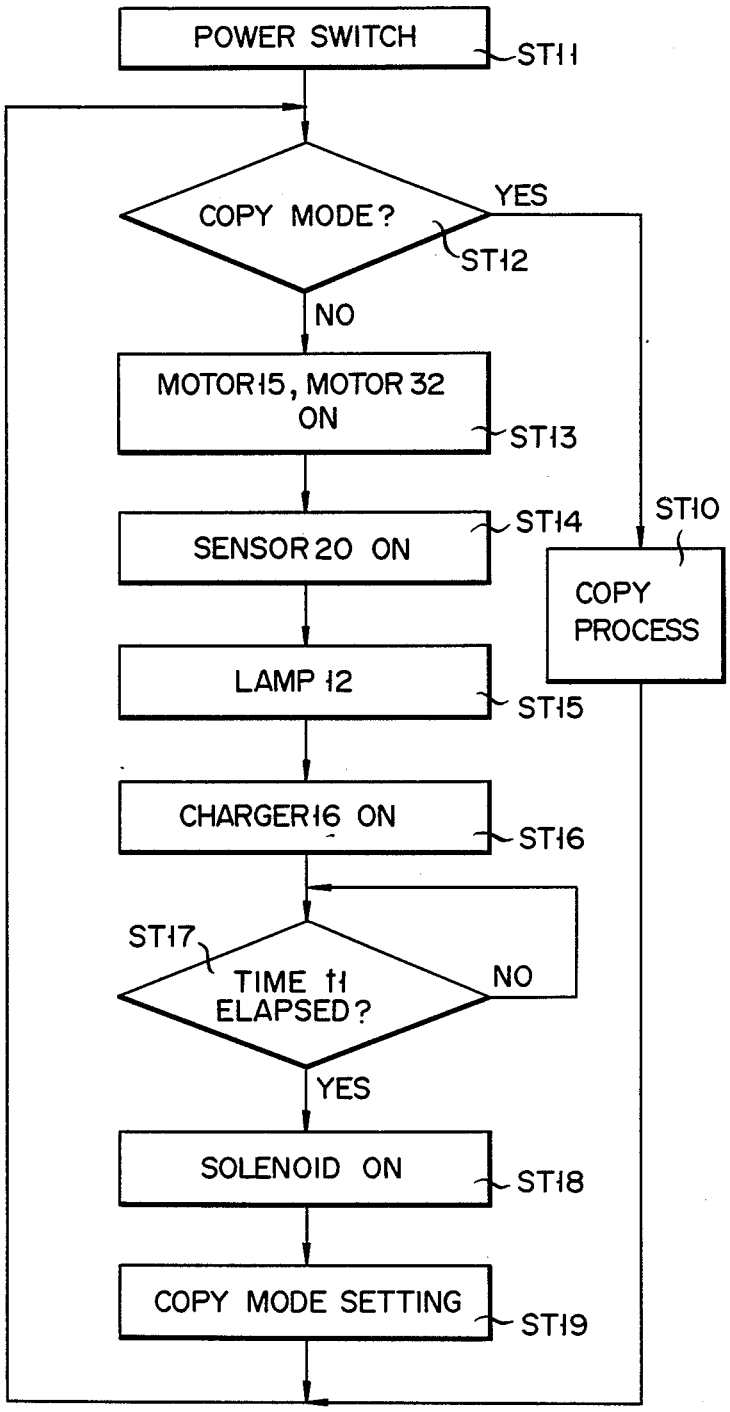
FIG. 7 a flow chart illustrating the control sequence.
Figures 8A, 8B, 8C, 8D, 8E, 8F, 8G:
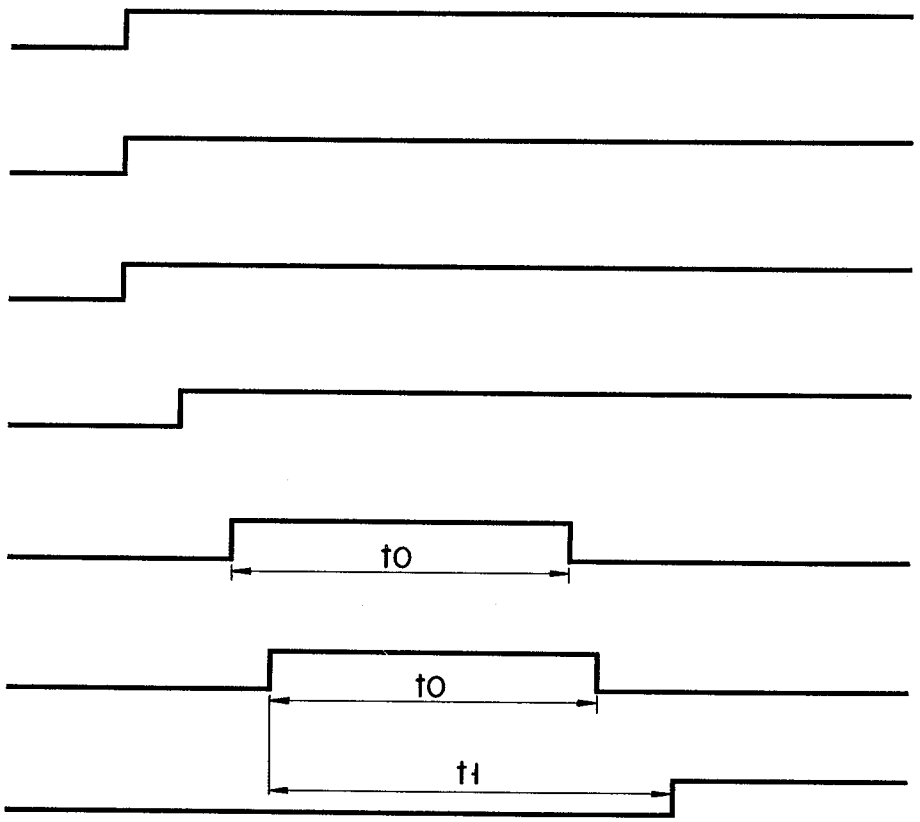
FIGS. 8A to 8G are timing charts.

If a power switch (not shown) on control panel 35 shown in FIG. 6 is turned on after the installation of the copying apparatus is completed, for example, the automatic initial setting mode is established in control unit 36. In response to an instruction from unit 36, motors 15 and 32 for driving photosensitive drum 14 and developing roller 18, respectively, and bias source 19 are actuated as shown in FIGS. 8A, 8B and 8C. Then, sensor 20 starts to be operated, so that the toner content of the developing agent in developing unit 17 is detected. Steps 11 to 14 (FIG. 7) for these processes are identical with steps 1 to 4 (FIG. 3), respectively. Thereafter, exposure lamp 12 is lit (FIG. 8E, ST16), and main charger 16 is actuated after some delay (FIG. 8F, ST16). At this time, cleaning blade 28 is kept apart from drum 14, as indicated by broken line in FIG. 5. In this state, control unit 36 operates so that lamp 12 and charger 16 are turned off after the passage of time $t_0$, as shown in FIGS. 8E and 8F. Regularly pre-exposed to de-electrifying light L, that region of drum 14 indicated by center angle Q in FIG. 5 has a predetermined black ground potential. An electric charge layer is formed only on region Q by charger 16. Further, region Q is developed by developing unit 17 and formed exclusively with a toner layer as drum 14 rotates. When the toner layer reaches position R corresponding to cleaning blade 28 shown in FIG. 5, or when predetermined time $t_1$ has elapsed after the start of charger 16, the solenoid or supporting device 29 for driving the blade is actuated by control unit 36. As a result, blade 28 engages drum 14 with the toner layer between the two. Thus, the setting operation is completed. Thereafter, for example, the normal copy mode is established.

According to the embodiment described above, a toner layer with a predetermined with is formed on the surface of photosensitive drum 14 by controlling the operation timing of exposure lamp 12 and main charger 16. When the toner layer reaches the location of cleaning blade 28, the blade is brought into contact with the layer. Thus, the setting operation can securely be accomplished by a simple process of timing control.

Once the automatic initial setting mode is established, moreover, the operator need not perform any operation. Accordingly, the operation is very easy, and the apparatus can be prevented from being damaged by wrong operation.

Alternatively, cleaning blade 28 may be brought into contact with the toner layer on the surface of drum 14 after the drum has rotated two or more times.

Referring now to FIGS. 9 and 10A to 10E, a third embodiment of the present invention will be described. A description of the arrangement of members of this embodiment, which is just the same as that of the second embodiment, is omitted herein. The second and third embodiments are different only in the control sequence of control unit 36.

Figure 9:
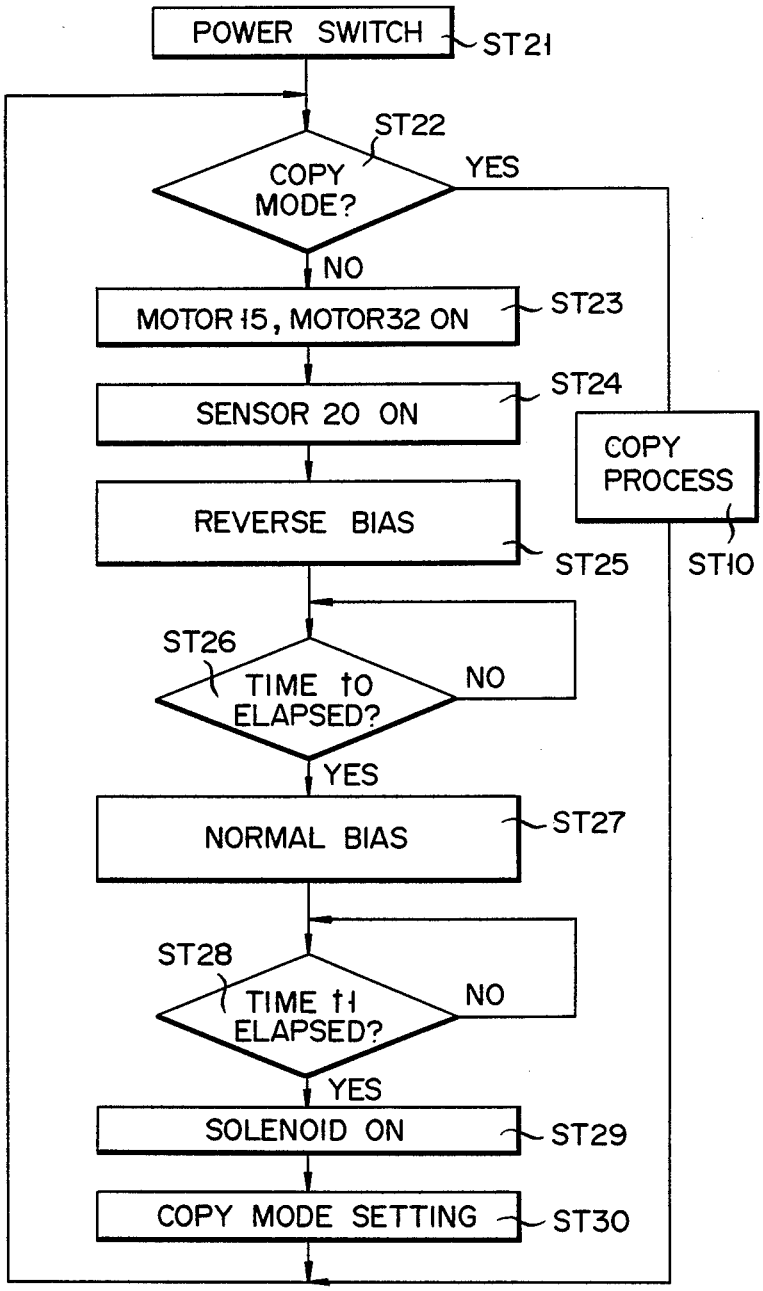
FIG. 9 is a flow chart illustrating the control sequence.
Figures 10A, 10B, 10C, 10D, 10E:
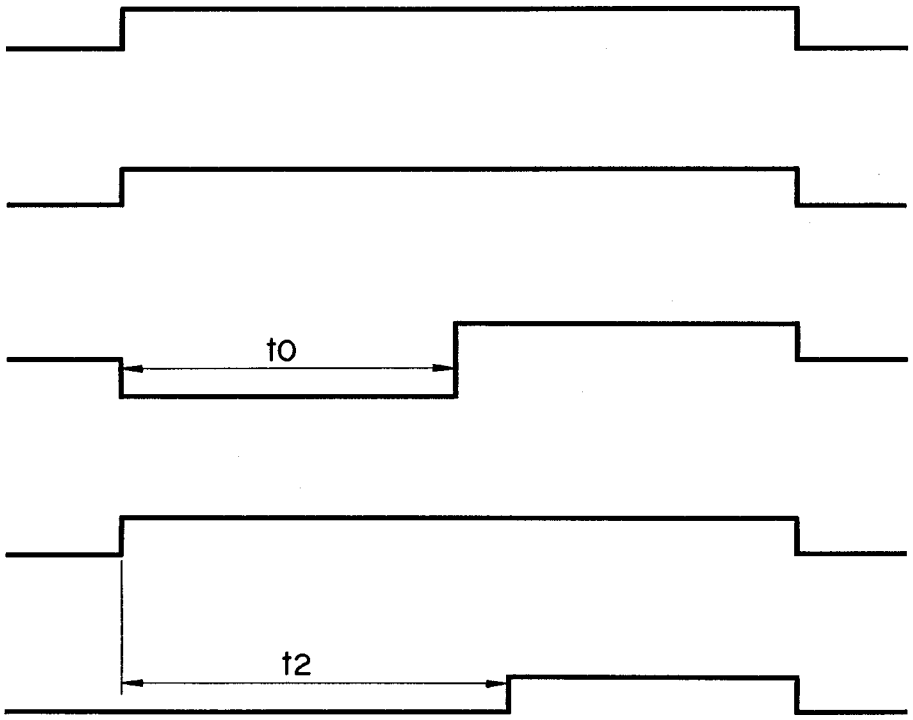
FIGS. 10A to 10E are timing charts.
Figure 11:
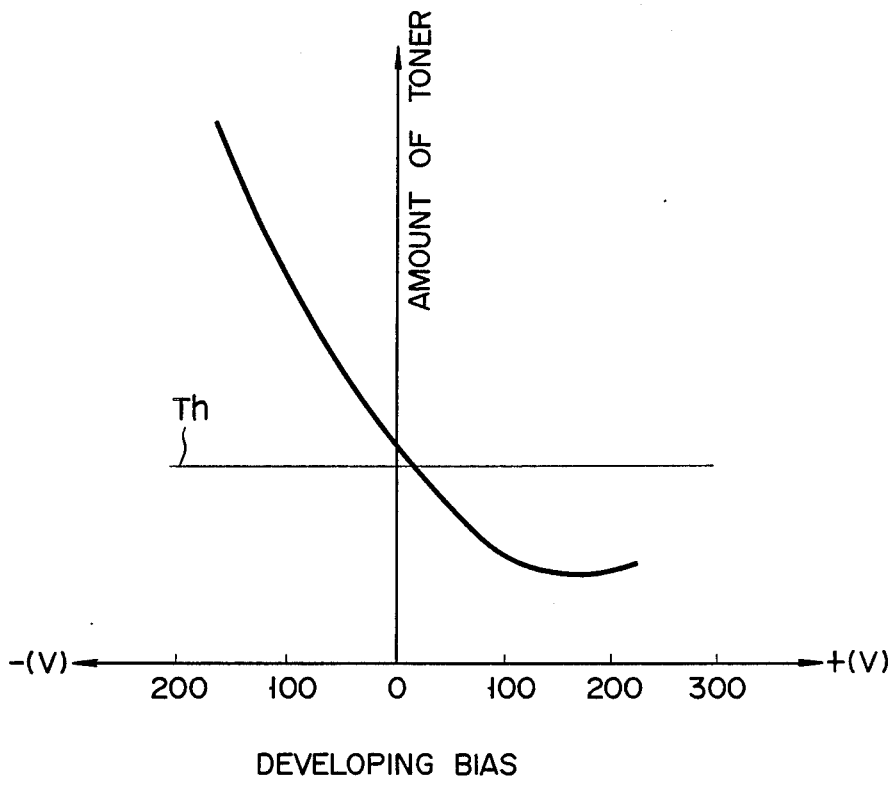
FIG. 11 is a graph showing the relationship between developing bias voltage and amount of toner on a photosensitive drum.

If a power switch (not shown) on control panel 35 is turned on, as shown in FIG. 9, in the initial setting, the automatic initial setting mode is established in control unit 36. In response to an instruction from unit 36, motors 15 and 32 (FIGS. 10A and 10B) for driving drum 14 and developing roller 18 of developing unit 17, respectively, are actuated. Then, sensor 20 (FIG. 10D) is started (ST24). At this time, the solenoid for driving cleaning blade 28 is off, so that the blade is kept apart from drum 14, as indicated by broken line in FIG. 5. In this state, control unit 36 operates so that a developing bias for roller 18 is kept reverse to the normal bias for time $t_0$ of FIG. 10C (ST25, ST26). Accordingly, an electric field is generated between drum 14 and roller 18, and serves to form a toner layer on the surface of the drum as the drum rotates. If the developing bias is converted to a forward bias (ST27), and when the toner layer reaches position R corresponding to blade 28 shown in FIG. 5, or when time $t_2$ has elapsed after the impression of the inverse bias, as shown in FIG. 10E, the solenoid for driving the blade is actuated by control unit 36 (ST28, ST29). As a result, blade 28 engages drum 14 with the toner layer between the two. Thus, the setting operation is completed. Thereafter, when drum 14 makes one revolution or more, for example, motors 15 and 32 and developing bias source 19 are stopped or turned off. Thereupon, drum 14 is stopped, and the solenoid for blade 28 is deenergized. FIG. 11 shows the relationship between developing bias and amount of toner attached to the photosensitive drum. For the setting operation, the toner amount must be not less than Th. A toner layer with a desired thickness can be obtained by varying the developing bias within a range for amount Th or more.

According to the embodiment described above, a toner layer is formed on the surface of photosensitive drum 14 by making the developing bias of developing unit 17 reverse to the normal bias, and cleaning blade 28 is brought into contact with the toner layer when the layer reaches the location of the blade. Thus, the setting can be accomplished securely by only simple timing control of the developing bias and various sections, without additional use of any special equipment.

What is claimed is:

1. An image forming apparatus comprising:

a drum-shaped photosensitive member having an axis of rotation;

drive means for rotating the photosensitive member about the rotation axis;

charging means for forming an electrically charged region on the surface of the photosensitive member;

latent image forming means for irradiating the charged region of the photosensitive member with a light to form an electrostatic latent image on the surface;

developing means for supplying a toner to the surface of the photosensitive member to develop the electrostatic latent image into a visible image formed of the toner;

a cleaning blade for removing the residual toner on the surface of the photosensitive member;

blade support means adapted to bringing the cleaning blade into contact with the surface of the photosensitive member;

toner adjusting means for keeping the density of the toner constant, the toner density adjusting means including sensing means for detecting the density of the toner in the developing means, and resupply means for feeding the toner to the developing means in accordance with the result of the detection by the sensing means; and control means having an initial setting mode and an operating mode, and adapted, when the initial setting mode is selected, to actuate first the drive means, charging means, and toner density adjusting means, and thereafter to energize the developing means to form the visible image on the surface of the photosensitive member and to actuate the blade supporting means to bring the cleaning blade into contact with the surface of the photosensitive member when the toner layer reaches the location of the cleaning blade.

2. The image forming apparatus according to claim 1, further comprising means for de-electrifying the surface of the photosensitive member.

3. The image apparatus according to claim 2, wherein said de-electrifying means includes a discharge lamp for irradiating the surface of the photosensitive member.

4. The image forming apparatus according to claim 1, wherein said latent image forming means includes a light source for irradiating a light beam and light-beam scanning means for leading the light beam from the light source onto the surface of the photosensitive member, thereby selectively irradiating the surface with the beam.

5. The image forming apparatus according to claim 4, wherein said de-electrifying means includes light guide means for guiding the light beam from the light source of the latent image forming means onto the surface of the photosensitive member.

6. The image forming apparatus according to claim 5, wherein said control means actuates the drive means, turns on the light source of the latent image forming means to optically de-electrify the surface of the photosensitive member and actuates the charging means to form the uniformly charged region on the surface, when the initial setting mode is selected, and turns off the light source when the charged region reaches the location of the light-beam scanning means, and then energizes the developing means.

7. The image forming apparatus according to claim 1, wherein said developing means includes toner supply means and bias applying means for applying a developing bias voltage to the supply means, and said control means converts the bias voltage of the bias applying means to an inverse bias voltage, thereby forming the developing agent layer on the surface of the photosensitive member, when the initial setting mode is selected.

8. The image forming apparatus according to claim 1, further comprising transfer means for feeding an object of transfer onto the surface of the photosensitive member with the visible image thereon and transferring the visible image to the object of transfer.

9. The image forming apparatus according to claim 1, wherein the toner density adjusting means is actuated before the developing means and after the drive means.

10. An image forming apparatus comprising:

a drum-shaped photosensitive member having an axis of rotation;

drive means for rotating the photosensitive member about the rotation axis;

charging means for forming an electric charged region on the surface of the photosensitive member;

latent image forming means for irradiating the charged region of the photosensitive member with a light to form an electrostatic latent image on the surface;

developing means for supplying a toner to the surface of the photosensitive member to develop the electrostatic latent image into a visible image formed of the toner;

a cleaning blade for removing the residual toner on the surface of the phtosensitive member;

blade supporting means adapted to bring the cleaning blade into contact with the surface of the photosensitive member;

means for de-electrifying the surface of the photosensitive member; and control means having an initial setting mode and an operating mode, and adapted, when the initial setting mode is selected, to actuate first the drive means, de-electrifying means, and charging means, and thereafter to energize the developing means to form a layer of the toner on the surface of the photosensitive member, and to actuate the blade supporting means to bring the cleaning blade into contact with the surface of the photosensitive member when the toner layer reaches the location of the cleaning blade, wherein said latent image forming means includes a light source for irradiating a light beam and light-beam scanning means for leading the light beam from the light source onto the surface of the photosensitive member, thereby selectively irradiating the surface with the beam, wherein said de-electrifying means includes light guide means for guiding the light beam from the light source of the latent image forming means onto the surface of the photosensitive member, and wherein said control means actuates the drive means, turns on the light source of the latent image forming means to optically de-electrify the surface of the photosensitive member and actuates the charging means to form the uniformly charged region on the surface, when the intitial setting mode is selected, and turns off the light source when the charged region reaches the location of the light-beam scanning means, and then energizes the developing means.

11. The image forming apparatus according to claim 10, further comprising toner density adjusting means for keeping the density of the toner constant, said adjusting means including sensing means for detecting the density of the toner in the developing means, and resupply means for feeding toner to the developing means in accordance with the result of the detection by the sensing means, wherein the toner density adjusting means is actuated by the control means before the developing means and after the drive means.

* * * * *